US009162484B2

(12) United States Patent
Hoshino

(10) Patent No.: US 9,162,484 B2
(45) Date of Patent: Oct. 20, 2015

(54) LIQUID DISCHARGING APPARATUS

(71) Applicant: SEIKO EPSON CORPORATION, Tokyo (JP)

(72) Inventor: Masaru Hoshino, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/095,627

(22) Filed: Dec. 3, 2013

(65) Prior Publication Data

US 2014/0151949 A1 Jun. 5, 2014

(30) Foreign Application Priority Data

Dec. 5, 2012 (JP) ..... 2012-266536

(51) Int. Cl.
*B41J 2/015* (2006.01)
*B41J 11/00* (2006.01)

(52) U.S. Cl.
CPC ..... *B41J 11/0015* (2013.01)

(58) Field of Classification Search
CPC ..... B41J 2/1623; B41J 2/1631; B41J 2/1628; B41J 2/14024; B41J 2/1603
USPC ..... 347/20, 104, 101
See application file for complete search history.

(56) References Cited

U.S. PATENT DOCUMENTS

| | | | | |
|---|---|---|---|---|
| 4,629,447 | A * | 12/1986 | Stenzel | 493/356 |
| 2009/0226236 | A1 | 9/2009 | Yamashita et al. | |
| 2009/0245913 | A1 * | 10/2009 | Yamamoto | 400/621 |
| 2012/0021884 | A1 * | 1/2012 | Musha | 493/405 |

FOREIGN PATENT DOCUMENTS

JP 2009-214200 9/2009

* cited by examiner

*Primary Examiner* — Manish S Shah
*Assistant Examiner* — Yaovi Ameh
(74) *Attorney, Agent, or Firm* — Workman Nydegger

(57) ABSTRACT

A liquid discharging apparatus includes: a head which discharges liquid on a medium; a transportation section which transports the medium in a transportation direction; a creasing section which performs creasing on the medium; and a clamping section which clamps the medium between the head and the creasing section in the transportation direction.

9 Claims, 6 Drawing Sheets

LIQUID DISCHARGING APPARATUS

BACKGROUND

1. Technical Field

The present invention relates to a liquid discharging apparatus.

2. Related Art

An ink jet type printing apparatus is developed which forms an image on a continuous paper sheet by feeding the paper from a roll body. In such a printing apparatus, the paper on which the image is formed is cut by a cutter of a downstream portion in a transportation direction.

A printing apparatus including a cutter which cuts a material to be cut is disclosed in JP-A-2009-214200.

This application proposes a novel printing apparatus capable of performing creasing. However, in the operation for performing the creasing, since tension pulling the medium in the transportation direction occurs, there is a concern that the medium may be moved in the transportation direction. If the medium is moved in the transportation direction, a position where the image is formed is varied due to an unexpected moving amount thereof. Therefore, it is preferable that the image formation having less deviation with respect to the medium be performed even when performing the creasing operation.

SUMMARY

An advantage of some aspects of the invention is to perform image formation having less deviation with respect to a medium even when performing a creasing operation.

According to an aspect of the invention, there is provided a liquid discharging apparatus including: a head which discharges liquid on a medium; a transportation section which transports the medium in a transportation direction; a creasing section which performs creasing on the medium; and a clamping section which clamps the medium between the head and the creasing section in the transportation direction.

Other features of the invention will be apparent from the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
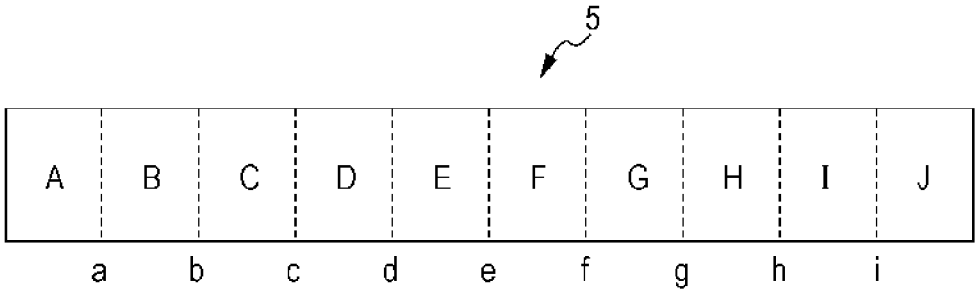
FIG. 1A is a view illustrating an example of a printed matter for laminated paper binding.

At least the following matters will be clear by the description of the specification and accompanying drawings. That is, a liquid discharging apparatus includes: a head which discharges liquid on a medium; a transportation section which transports the medium in a transportation direction; a creasing section which performs creasing on the medium; and a clamping section which clamps the medium between the head and the creasing section in the transportation direction.

Therefore, since the clamping section can clamp the medium between the head and the creasing section, tension which moves the medium in the transportation direction occurs when the creasing section performs the creasing; however, it is possible to eliminate the tension by a reaction force of the clamping section and to suppress the moving of the medium in the transportation direction. Then, it is possible to perform the image formation having less deviation with respect to the medium even when performing the creasing operation.

In such a liquid discharging apparatus, it is preferable that the clamping section be one set of roller capable of controlling rotation and stop thereof.

Therefore, it is possible to suppress the moving of the medium in the transportation direction by performing the control to stop the rollers while clamping the medium when performing the creasing.

In addition, it is preferable that the clamping section limit the moving of the medium in the transportation direction when the creasing section performs the creasing on the medium.

Therefore, since the moving of the medium in the transportation direction is limited when performing the creasing, unexpected moving of the medium is suppressed and then it is possible to perform the image formation having less deviation with respect to the medium.

In addition, it is preferable that the clamping section include another clamping section which is provided on the downstream side of the head in the transportation direction and clamps the medium on the downstream side of the creasing section.

Therefore, since two sets of clamping sections are included so as to interpose the creasing section in the transportation direction, it is possible to perform the creasing by the creasing section while suppressing the moving of the medium in the transportation direction by both clamping sections. Thus, it is possible to reduce a deviation amount in the position of the creasing.

In addition, it is preferable that the medium be continuously supplied from a roll body; and a cutting section which cuts the medium be provided on the downstream side of the clamping section.

Therefore, it is possible to cut the medium where the image formation and the creasing are performed. Then, it is possible to easily provide a so-called photo book with aesthetically pleasant features by performing a folding process in a position where the creasing is performed with respect to the medium.

In addition, it is preferable that the creasing section include a convex-shaped member which linearly pushes the medium; and a receiving member which receives the convex-shaped member.

Therefore, it is possible to perform the creasing by inserting the medium between the convex-shaped member and the receiving member.

In addition, it is preferable that the convex-shaped member be a dot impact head which hits the medium while moving in a direction intersecting the transportation direction.

Therefore, it is possible to not only put the crease with the dot impact head but also to form a mark capable of being recognized by a photo sensor with the dot impact head. Then, it is possible to specify the position of the medium corresponding to the position of the mark.

In addition, the creasing section and the cutting section may be provided in the same position in the transportation direction.

Since it is rare that the creasing and the cutting are performed at the same time in the same position with respect to the paper, it is possible to provide the creasing section and the cutting section in the same position in the transportation direction. Then, it is possible to shorten the length of the liquid discharging apparatus in the transportation direction.

Embodiment

The types of bindings include side stitching, unsewn binding and the like. The side stitching is a binding method in which a plurality of papers are stitched by thread, wire or the like. The unsewn binding is a binding method in which a back portion becoming a book cover is fixed by adhesive.

In those binding methods, the back portion is fixed. Thus, if a photo book is produced in which a single photograph is seen in a double page, there is a problem that a joint portion of the left and right page layout is hard to see because the left and right pages are not completely open. In addition, it is difficult to employ such a binding method in the photo book or the like because deviation may occur in the left and right pages.

There is a laminated paper binding method as the binding method in which the left and right pages are easy to see continuously when the left and right pages are open, even after the binding is performed.

Figure 1B:
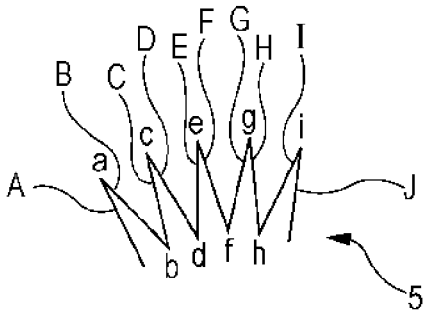
FIG. 1B is an explanatory view of folding of the laminated paper binding and FIG. 1C is an explanatory view of the laminated paper binding with a printed matter.
Figure 1C:
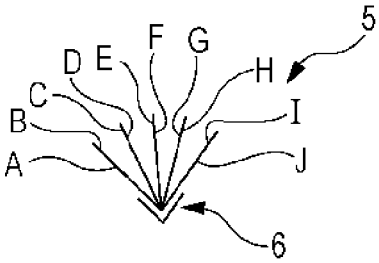

FIG. 1A is a view illustrating an example of a printed matter 5 for laminated paper binding. FIG. 1B is an explanatory view of folding of the laminated paper binding. FIG. 1C is an explanatory view of the laminated paper binding with a printed matter.

The printed matter 5 for the laminated paper binding is produced when the laminated paper binding is performed. In the printed matter 5 for the laminated paper binding, the printing is performed on one side of the paper. For example, the printing is performed on areas indicated by alphabetical capital letters illustrated in FIG. 1A. Furthermore, in the printed matter 5, mountain folds or valley folds are performed in lines indicated by alphabetical small letters when the laminated paper binding is performed (FIG. 1B).

Then, a book is made in which the laminated paper binding is performed by gluing on a back surface of the printed matter 5 and by gluing a back cover 6 (FIG. 1C).

Therefore, the laminated paper binding is made by performing the printing on one surface of the paper S supplied from a roll body with such ink jet type printing apparatus and a book such as a so-called a photo book having easy-to-see double pages can be easily produced.

In an embodiment described below, in order to facilitate the laminated paper binding, a novel printing apparatus having a creaser which forms a folding line in the printed matter 5 is provided. However, if a printing position or a creasing position is deviated, the folding line is deviated when the creasing is performed by the creaser. The deviation of such a folding line is accumulated. Thus, a part of a previous page comes into the next page so that the photo book which is short in aesthetically pleasant features may be produced.

Thus, in the embodiment, the printing apparatus is provided which performs image formation having less deviation with respect to the medium and is suitable for the laminated paper binding even when performing a creasing operation.

Figure 2:
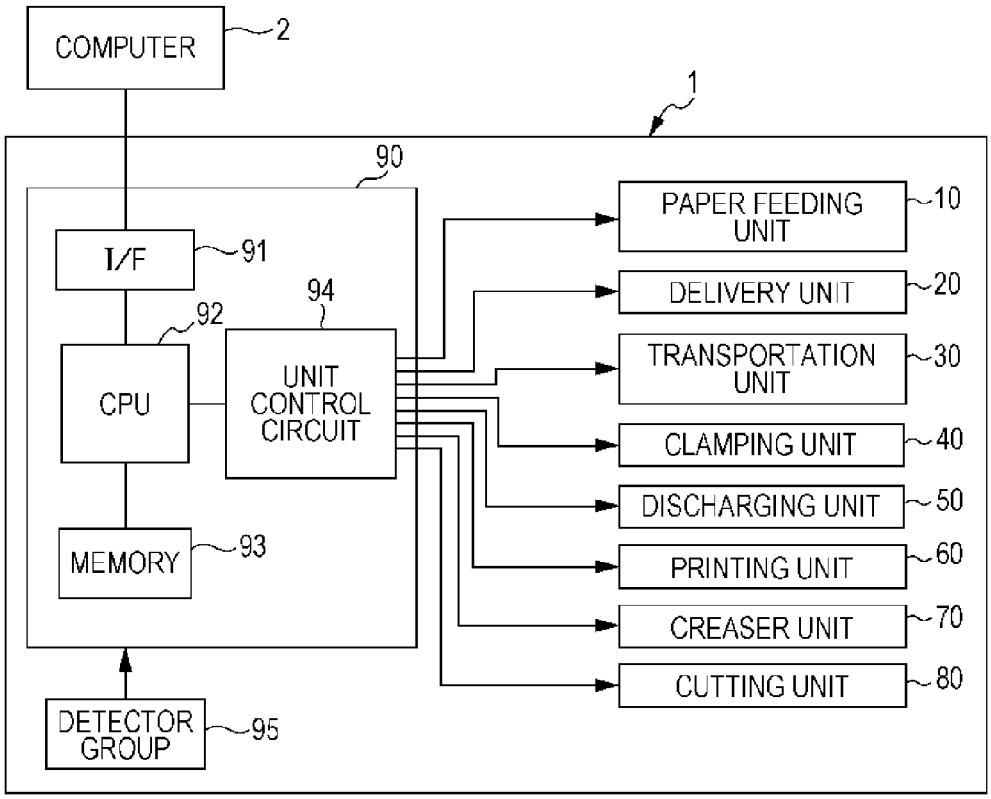
FIG. 2 is a block diagram of a printing apparatus in the embodiment.
Figure 3:
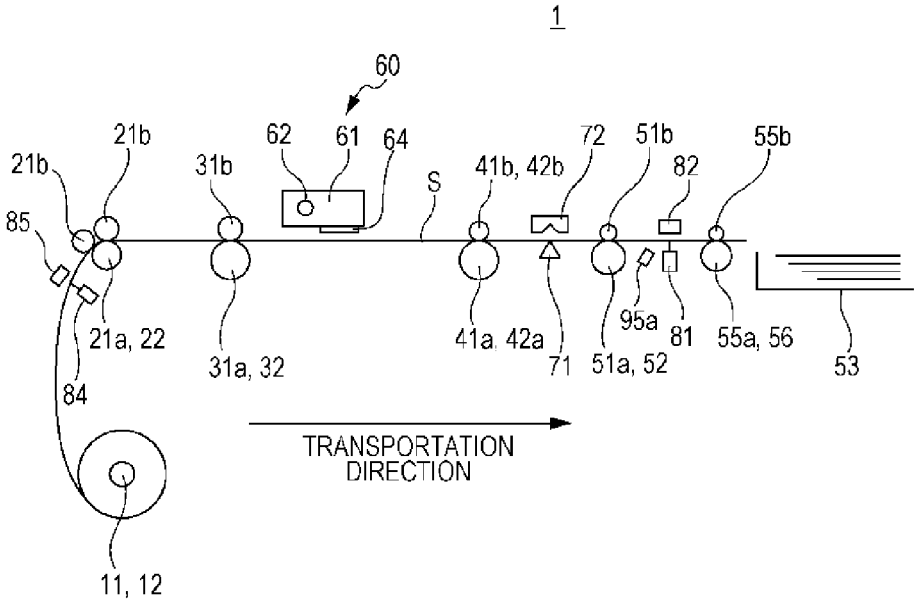
FIG. 3 is a side view of the printing apparatus in the embodiment.

FIG. 2 is a block diagram of a printing apparatus 1 in the embodiment. FIG. 3 is a side view of the printing apparatus 1 in the embodiment. Hereinafter, a configuration of the printing apparatus 1 will be described with reference to the drawings.

The printing apparatus 1 is a so-called ink jet type printing apparatus which forms an image on a paper S (corresponding to a medium) by discharging ink. The printing apparatus 1 includes a paper feeding unit 10, a delivery unit 20, a transportation unit 30 (corresponding to a transportation section), a clamping unit 40 (corresponding to a clamping section), a discharging unit 50, a printing unit 60, a creaser unit 70 (corresponding to a creasing section), a cutting unit 80 (corresponding to a cutting section), a controller 90, and a detector group 95.

The controller 90 includes an interface 91 for connecting to a computer 2. Thus, it is possible to perform bidirectional communication with the computer 2. Then, a printing command is transmitted to the printing apparatus 1 through a printer driver installed on the computer 2.

The controller 90 further includes a Central Processing Unit (CPU) 92 as a calculator, a memory 93 as a storage device, and a unit control circuit 94 which controls each unit. Thus, the printing command transmitted from the printing apparatus 1 is interpreted and each unit described below is controlled.

The paper feeding unit 10 includes a paper feeding roll shaft 11 and a paper feeding roll motor 12. The roll-shaped paper S is set on the paper feeding roll shaft 11. In addition, an output shaft of the paper feeding roll motor 12 is connected to the paper feeding roll shaft 11 through a gear (not illustrated) or the like in a power transmittable manner. Thus, it is possible to control the rotation of the paper feeding roll shaft 11 by controlling the paper feeding roll motor 12 with the controller 90. The rotation of the paper feeding roll shaft 11 is controlled with the controller 90 so that the paper S is slightly loosed between the paper feeding roll shaft 11 and a transportation roller 21*a* described below. Then, tension is prevented from occurring between the paper feeding roll shaft 11 and the delivery roller 21*a*.

The delivery unit 20 includes the delivery roller 21*a*, a driven roller 21*b* and a delivery motor 22. The paper S is inserted between the delivery roller 21*a* and the driven roller 21*b*. An output shaft of the delivery motor 22 is connected to a shaft of the delivery roller 21*a* through a gear (not illustrated) or the like in a power transmittable manner. Thus, it is possible to control the rotation of the delivery roller 21*a* by controlling the delivery motor 22 with the controller 90. The driven roller 21*b* is driven and rotated by a frictional force between the delivery roller 21*a* and the paper S.

The delivery roller 21*a* is controlled by the controller 90 so as to appropriately deliver the paper S pulled out from the paper feeding roll shaft 11 to a transportation roller 31*a* described below.

The transportation unit 30 includes the transportation roller 31*a*, a driven roller 31*b* and a transportation motor 32. The paper S is inserted between the transportation roller 31*a* and the driven roller 31*b*. An output shaft of the transportation motor 32 is connected to a shaft of the transportation roller 31*a* through a gear (not illustrated) or the like in a power transmittable manner. Thus, it is possible to control the rotation of the transportation roller 31*a* by controlling the transportation motor 32 with the controller 90. The driven roller 31*b* is driven and rotated by a frictional force between the delivery roller 31*a* and the paper S.

The transportation roller 31*a* transports the paper S, which is delivered from the delivery roller 21*a*, below a printing head 64 with the controller 90. As will be described later, the printing with the printing head 64 is performed by alternately performing the movement of a carriage 61 in a paper width direction and the transportation of the paper S. The transportation roller 31*a* performs the transportation of the paper S.

The clamping unit 40 includes a lower side clamping roller 41*a*, an upper side clamping roller 41*b*, a lower side clamping motor 42*a* and an upper side clamping motor 42*b*. An output shaft of the lower side clamping motor 42*a* is connected to a shaft of the lower side clamping roller 41*a* through a gear (not illustrated) or the like in a power transmittable manner. In addition, an output shaft of the upper side clamping motor 42*b* is connected to a shaft of the upper side clamping roller 41*b* through a gear (not illustrated) or the like in a power transmittable manner.

Thus, it is possible to control the transportation of the paper S using the lower side clamping roller 41*a* and the upper side clamping roller 41*b* by controlling the lower side clamping motor 42*a* and the upper side clamping motor 42*b* with the controller 90. That is, it is possible to limit the transportation of the paper S and the moving of the paper S under the control.

Here, the moving of the paper S is limited by the power of the two clamping motors 42*a* and 42*b*; however, only one clamping motor is provided and the other clamping roller may be a driven roller.

The discharging unit 50 includes an upstream side discharging roller 51*a*, a driven roller 51*b* and an upstream side discharging motor 52. In addition, the discharging unit 50 further includes a downstream side discharging roller 55*a*, a driven roller 55*b* and a downstream side discharging motor 56.

An output shaft of the upstream side discharging motor 52 is connected to a shaft of the upstream side discharging roller 51*a* through a gear (not illustrated) or the like in a power transmittable manner. In addition, an output shaft of the downstream side discharging motor 56 is connected to a shaft of the downstream side discharging roller 55*a* through a gear (not illustrated) or the like in a power transmittable manner. The driven roller 51*b* is driven and rotated by a frictional force between the upstream side discharging roller 51*a* and the paper S. The driven roller 55*b* is driven and rotated by a frictional force between the downstream side discharging roller 55*a* and the paper S.

Therefore, the paper S where the image formation and the creasing are completed is transported to a paper discharging side and the paper S which is cut by the cutting unit 80 described below is discharged to a paper discharging tray 53.

The printing unit 60 includes the carriage 61, a guide shaft 62 and the printing head 64. The guide shaft 62 extends in a direction perpendicular to the transportation direction. The guide shaft 62 is supported by a main body case of the printing apparatus 1 and the carriage 61 is slidably connected to the guide shaft 62 in a reciprocally movable state along a longitudinal direction of the guide shaft 62. A carriage motor and a belt (not illustrated) are connected to the carriage 61. Thus, the carriage 61 reciprocates in the longitudinal direction of the guide shaft 62 described above.

In addition, the carriage 61 has the printing head 64 (corresponding to a head). The printing head 64 ejects the ink onto the paper S. Thus, since the printing head 64 is reciprocally movable in a direction intersecting the transportation direction, it is possible to form the image on the entire surface of the paper S by repeating the transportation of the paper S and reciprocation of the carriage 61.

Figure 4:
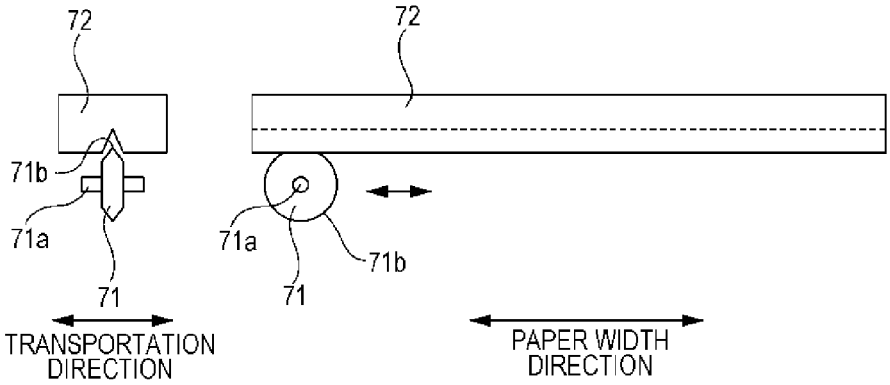
FIG. 4 is an explanatory view of a creaser in the embodiment.

FIG. 4 is an explanatory view of the creaser in the embodiment. In FIG. 4, a side view and a front view of the creaser unit 70 are illustrated. The creaser unit 70 includes a rotation blade 71 and a blade receiving member 72.

The rotation blade 71 has a shaft 71*a* and a blade 71*b* formed over a circumference thereof. Then, the rotation blade 71 is rotatable about the shaft 71*a* and is movable in the width direction of the paper S. The blade receiving member 72 has an acute angle cross-section in a side view and accordingly, an edge of the blade 71*b* also has an acute angle cross-section. However, the edge of the blade 71*b* has an acute angle but stress does not occur before cutting the paper S.

Thus, the stress due to the edge of the blade 71*b* forms a linear crease (a folding line) extending in the width direction on the paper S by inserting the paper S between the blade 71*b* and the blade receiving member 72, and by moving the rotation blade 71 in the width direction of the paper S.

A metal material such as iron, nickel, aluminum and alumite can be used for the rotation blade 71 and the blade receiving member 72. In addition, resin may be used instead of metal.

In addition, here, the cross-section of the blade receiving member 72 is described as the acute angle cross-section; however, the cross-section thereof may be a laterally long rectangular-shaped cross-section and may be a longitudinally long rectangular-shaped cross-section. In addition, the crease may be formed by providing a blade which is not rotated instead of the rotation blade 71 and by sliding the blade simply in the paper width direction.

In addition, the creaser unit 70 can also be exchanged. Thus, maintenance of the creaser unit 70 is easily performed and it is possible to use the creaser unit 70 which is optimal to the paper S by installing the blade receiving member 72 having a different depth, width or shape thereof.

The cutting unit 80 includes a cutter 81 and a cutter receiving member 82. For example, the cutter 81 can be realized by adopting a member of which an edge is sharper than that of the blade 71*b* of the rotation blade 71 illustrated in FIG. 4 described above. In addition, the cutter receiving member 82 can be realized by adopting a member of which a material is more rigid than that of the blade receiving member 72.

It is possible to cut the paper S at a predetermined position by using such a configuration, by inserting the paper S between the cutter 81 and the cutter receiving member 82 and by moving the cutter 81 in the width direction of the paper S.

In addition, it is possible to include a dot impact head 84 and a platen 85 as a part of the cutting unit 80. The dot impact head 84 prints printing information and a marker indicating a position in which the paper S is cut by the cutter 81 described above on a back surface (a surface opposite to the surface on which the image is formed) of the paper S. Then, an accurate cutting position is recognizable by reading the marker with a photo sensor 95*a*, which will be described later.

The printing apparatus 1 includes the photo sensor 95*a* as one of the detector groups 95. The photo sensor 95*a* is provided between the upstream side discharging roller 51*a* and the downstream side discharging roller 55*a* in the transportation direction. In addition, the photo sensor 95*a* is provided on the back surface side of the paper S so as to read the marker formed on the paper S as described above.

Thus, the controller 90 can accurately recognize the cutting position of the paper S by providing the photo sensor 95*a*. Then, it is possible to cut the paper S at an accurate position by controlling the cutter 81 appropriately.

Figure 5:
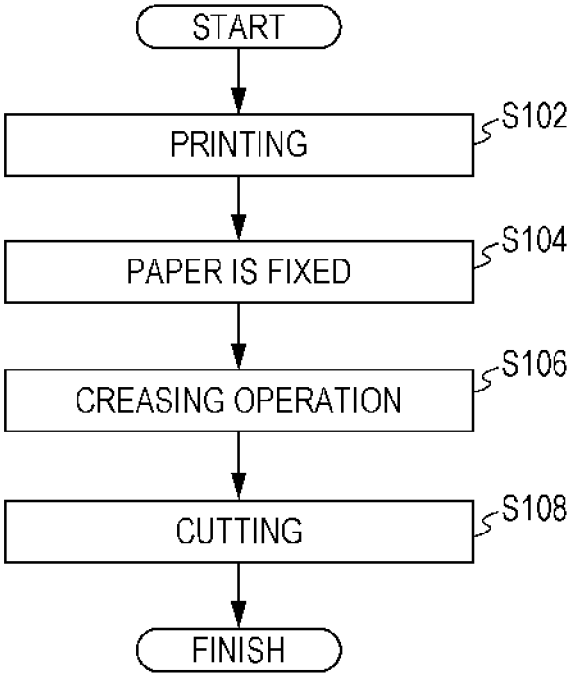
FIG. 5 is a flowchart of a printing method in the embodiment.

FIG. 5 is a flowchart of a printing method in the embodiment. Hereinafter, the printing method will be described with reference to the flowchart.

First, the printing is performed on the paper S (S102). The printing is performed by intermittently transporting the paper supplied from the paper feeding roll shaft 11 by the transportation roller 31*a* and by discharging the ink from the printing head 64.

When forming the image on the paper S, the lower side clamping roller 41*a* and the upper side clamping roller 41*b* clamp and transport the paper S to an extent that a predetermined tension occurs between the rollers 41*a* and 41*b* and the transportation roller 31*a*.

A transportation amount of the paper S is always grasped in the controller 90 by a rotation amount of the transportation roller 31*a*. In addition, the controller 90 grasps a position where the creasing is performed on the paper S. Thus, the controller 90 controls the creaser unit 70 to perform the creasing when the transportation amount is a predetermined transportation amount.

In addition, the controller 90 stops and fixes the rotation of the lower side clamping roller 41*a* and the upper side clamping roller 41*b* at a timing when the creasing is performed by the creaser unit 70. That is, the paper S is fixed (S104).

After the paper S is fixed in the transportation direction, the controller 90 transmits a command to the creaser unit 70 that the creasing is performed on the paper S (S106). At this time, as described above, since the paper S is fixed in the transportation direction, the paper S is not moved even though the creasing is performed by the creaser unit 70. Thus, since the paper S is not nearly moved in the transportation direction when the creasing is performed, the printing deviation does not occur in the printing with respect to the following paper S.

For example, if the printing deviation occurs, the deviation in the printing position and the creasing position occurs. In that case, the position of the folding line of the photo book described above is deviated and the photo book with aesthetically pleasant features cannot be produced. However, according to the printing apparatus 1 of the embodiment, since the deviation in the printing position does not occur in the creasing operation in the creaser unit 70, it is possible to provide the printed matter for producing the photo book with aesthetically pleasant features.

In the paper S where more than one creasing is performed by the creaser unit 70, cutting is performed for one photo book unit (S108). As described above, the cutting is performed by reading the marker with the photo sensor 95*a* and by specifying the cutting position. The paper S which is cut is discharged to the paper discharging tray 53.

The operation is described in order from step S102 to step S108; however, practically, the operation is performed concurrently. That is, the creasing operation and the cutting operation are performed while performing the printing operation.

However, in the creaser unit 70 described above, the method using the rotation blade 71 is described; however, the creasing method is not limited to the embodiment.

Figure 6:
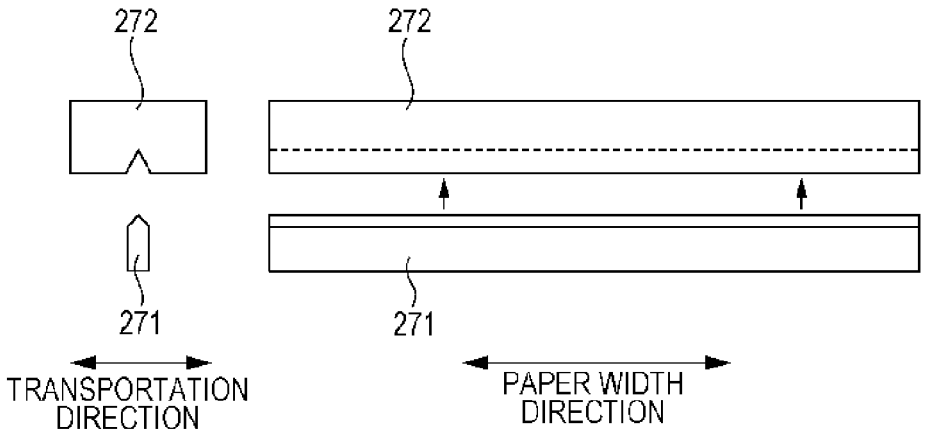
FIG. 6 is an explanatory view of a second creaser.

FIG. 6 is an explanatory view of a second creaser. FIG. 6 illustrates a blade 271 and a blade receiving member 272 in the second creaser. In the second creaser, the blade 271 is moved upwards from a lower surface side of the paper S and the paper S is inserted between the blade 271 and the blade receiving member 272. Also by doing so, it is possible to perform the creasing on the paper S.

Furthermore, here, the blade 271 is moved upwards from the lower surface side of the paper S to the blade receiving member 272 side; however, the blade 271 may be moved downwards from the upper surface side of the paper S and the paper S may be inserted between the blade 271 and the blade receiving member 272. In addition, in the creasing, the linear creasing is performed in the paper width direction of the paper S; however, a dashed line-shaped slit may be formed on the paper S.

Figure 7:
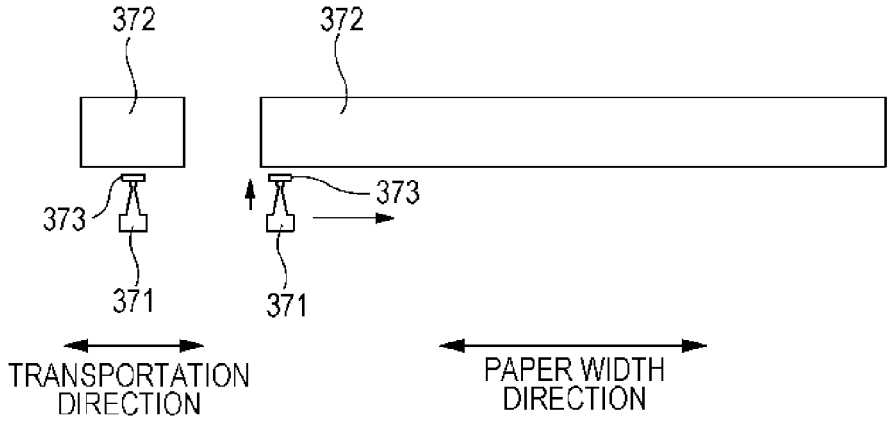
FIG. 7 is an explanatory view of a third creaser.

FIG. 7 is an explanatory view of a third creaser. FIG. 7 illustrates a dot impact head 371, a receiving member 372 and an ink ribbon 373 in the third creaser. As described above, in the third creaser, the dot impact head 371 performs the creasing by tapping the paper while moving the paper S in the paper width direction.

As described above, it is possible to freely control a width where the creasing is performed, the number of tapping and a pattern of the creasing by employing the dot impact head 371 as the creaser.

In addition, the marker for the photo sensor 95*a* described above to detect may be formed by using the dot impact head 371. Thus, it is possible to eliminate the need for the dot impact head 84 provided on the upstream side.

In addition, the creasing may be performed on the paper S by forming a plurality of small holes on the paper S by radiating laser in addition to the operation for mechanically performing the creasing as described above.

Other Embodiments

Figure 8:
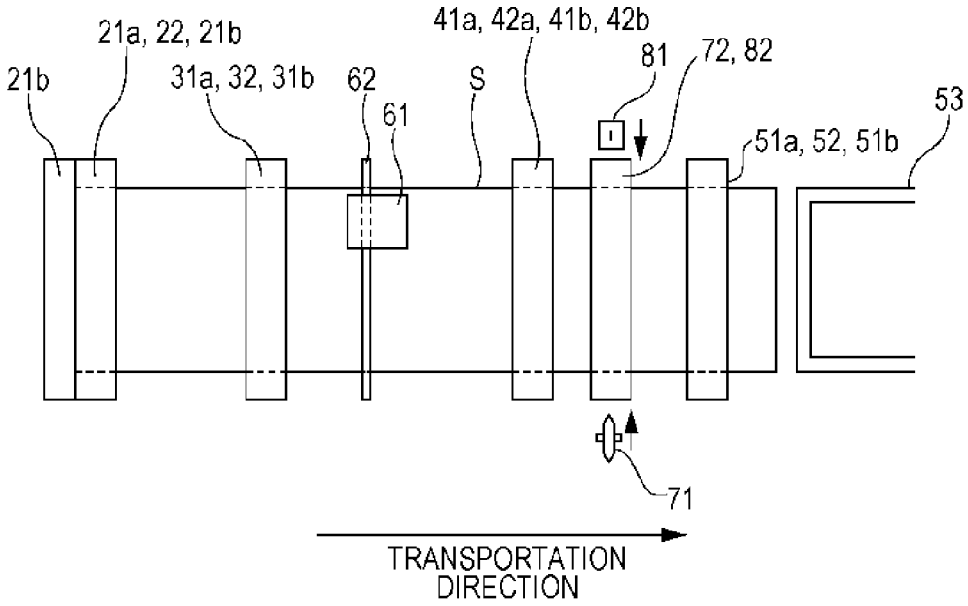
FIG. 8 is a top view of the printing apparatus in another embodiment.

FIG. 8 is a top view of the printing apparatus 1 in another embodiment. In the printing apparatus 1 illustrated in FIG. 8, the rotation blade 71 of the creaser unit 70 and the cutter 81 of the cutting unit 80 are disposed on the same position in the transportation direction of the paper S. However, the rotation blade 71 is disposed on the left side in the transportation direction and the cutter 81 is disposed on the right side in the transportation direction. Then, the blade receiving member 72 and the cutter receiving member 82 are disposed as a common member between the clamping roller 41*a* and the discharging roller 51*a*.

It is extremely rare that the creasing and the cutting are performed in the same position with respect to the paper S which is transported. Thus, no problem occurs in disposing the rotation blade 71 and the cutter 81 in the same position in the transportation direction. In addition, as described above, it is possible to shorten the length of the printing apparatus 1 in the transportation direction by disposing the rotation blade 71 and the cutter 81 in the same position in the transportation direction. In addition, it is possible to reduce the number of parts by disposing the blade receiving member 72 and the cutter receiving member 82 as the common member between the clamping roller 41*a* and the discharging roller 51*a*.

In the embodiments described above, the printing apparatus 1 is described as a liquid discharging apparatus; however, the invention is not limited to the embodiments. The invention can also be embodied in a liquid discharging apparatus that ejects or discharges fluid (liquid, a liquid material in which particles of a functional material are dispersed or a fluid material such as gel) other than the ink. For example, the same technology as the embodiments described above may be applied on various apparatuses where the ink jet technology is applied such as a color filter manufacturing apparatus, a dyeing apparatus, a micro-processing apparatus, a semiconductor manufacturing apparatus, a surface processing apparatus, a 3D modeling machine, a gas vaporizer, an organic EL manufacturing apparatus (in particular, a polymer EL manufacturing apparatus), a display manufacturing apparatus, a film forming apparatus and a DNA chip manufacturing apparatus. In addition, those methods or manufacturing methods are categories of application ranges.

The above embodiments are intended to facilitate the understanding of the invention and are not intended to limit the invention. The invention may be altered and improved without departing from the spirit thereof, and it goes without saying that the equivalents thereof are included in the invention.

The entire disclosure of Japanese Patent Application No. 2012-266536, filed Dec. 5, 2012 is expressly incorporated by reference herein.

What is claimed is:

1. A liquid discharging apparatus comprising:

a head which discharges liquid on a medium;

a transportation section which transports the medium in a transportation direction;

a creasing section which performs creasing on the medium and that includes a creaser;

a clamping section which clamps the medium between the head and the creasing section in the transportation direction;

a cutting section which cuts the medium is provided on the downstream side of the clamping section, wherein the cutting section includes a cutter; and a receiving member disposed across an entire width of the medium, wherein the creasing section and the cutting section are provided in the same position in the transportation direction and wherein the receiving member is common to both the creasing section and the cutting section and is configured to cooperate with the creaser to crease the medium and is configured to cooperate with the cutter to cut the medium, wherein the clamping section fixes the medium such that the medium is not moved in the transportation direction when the creasing section performs creasing.

2. The liquid discharging apparatus according to claim 1, wherein the clamping section is one set of roller pair capable of controlling rotation and stop thereof.

3. The liquid discharging apparatus according to claim 1, wherein the clamping section limits the moving of the medium in the transportation direction when the creasing section performs the creasing on the medium.

4. The liquid discharging apparatus according to claim 1, wherein the clamping section includes another clamping section which is provided on the downstream side of the head in the transportation direction and clamps the medium on the downstream side of the creasing section.

5. The liquid discharging apparatus according to claim 1, wherein the medium is continuously supplied from a roll body; and wherein a cutting section which cuts the medium is provided on the downstream side of the clamping section.

6. The liquid discharging apparatus according to claim 1, wherein the creasing section includes a convex-shaped member which linearly pushes the medium; and a receiving member which receives the convex-shaped member.

7. The liquid discharging apparatus according to claim 6, wherein the convex-shaped member is a dot impact head which hits the medium while moving in a direction intersecting the transportation direction.

8. The liquid discharging apparatus according to claim 1, wherein the clamping section includes a driving roller and a clamping motor, wherein the clamping motor limits rotation of the driving roller such that transportation of the medium in the transportation direction is limited when the creasing section performs creasing.

9. The liquid discharging apparatus according to claim 2, wherein the one set of roller pair includes the driving roller.

* * * * *